US008726557B2

(12) United States Patent
Stone et al.

(10) Patent No.: US 8,726,557 B2
(45) Date of Patent: May 20, 2014

(54) HAND GUARD ATTACHMENT SYSTEM FOR FIREARMS

(75) Inventors: Jeffrey W. Stone, Elizabethtown, KY (US); David O. Matteson, Horse Cave, KY (US)

(73) Assignee: RA Brands, L.L.C., Madison, NC (US)

( * ) Notice: Subject to any disclaimer, the term of this patent is extended or adjusted under 35 U.S.C. 154(b) by 30 days.

(21) Appl. No.: 12/820,840

(22) Filed: Jun. 22, 2010

(65) Prior Publication Data

US 2010/0319231 A1 Dec. 23, 2010

Related U.S. Application Data

(60) Provisional application No. 61/219,007, filed on Jun. 22, 2009.

(51) Int. Cl.
*F41C 23/00* (2006.01)
*F41C 23/16* (2006.01)

(52) U.S. Cl.
CPC ..... *F41C 23/00* (2013.01); *F41C 23/16* (2013.01)
USPC ..... 42/71.01

(58) Field of Classification Search
CPC ..... F41C 23/00; F41C 23/16
USPC ..... 42/71.01, 72, 124
See application file for complete search history.

(56) References Cited

U.S. PATENT DOCUMENTS

| | | | |
|---|---|---|---|
| 605,734 | A | 6/1898 | Mason |
| 613,860 | A | 11/1898 | Howard |
| 614,482 | A | 11/1898 | Mason |
| 804,255 | A | 11/1905 | McAllister |
| 1,083,708 | A | 1/1914 | Swebilius |
| 1,092,085 | A | 3/1914 | Wheeler et al. |
| 1,280,021 | A | 3/1918 | Otterson |
| 2,580,246 | A | 12/1951 | Schall |
| 2,620,581 | A | 12/1952 | Fiorini |
| 2,845,738 | A | 8/1958 | Butler |
| 3,112,645 | A | 12/1963 | Glass |
| 3,445,951 | A | 5/1969 | Bechard et al. |
| 3,883,976 | A | 5/1975 | Norman et al. |

(Continued)

FOREIGN PATENT DOCUMENTS

| | | |
|---|---|---|
| WO | WO 2004/085950 A2 | 10/2004 |
| WO | WO 2010/151552 | 12/2010 |

OTHER PUBLICATIONS

"Handle the Dark with Handleight," www.handlelight.com.
"TacStar and Alpec Shotgun Accessories," www.tigeneralstore.com.

(Continued)

*Primary Examiner* — Michelle Clement
(74) *Attorney, Agent, or Firm* — Womble Carlyle Sandridge & Rice, LLP

(57) ABSTRACT

A hand guard attachment assembly for a firearm having a barrel and a receiver fastened to the barrel by a barrel nut. The hand guard attachment assembly includes a forearm having a monolithic mounting rail/hand guard that is removably connected to the receiver. The monolithic rail/hand guard interfaces with an integral multi-slot mounting portion of the receiver. A cinch block is mated to the slots of the receiver and held in place by the monolithic rail/hand guard. A tension block is mated at one end of the monolithic rail/hand guard and is attached to the cinch block by a fastener to securely hold the monolithic rail/hand guard in place.

15 Claims, 10 Drawing Sheets

(56) References Cited

U.S. PATENT DOCUMENTS

| | | | | |
|---|---|---|---|---|
| 4,026,055 | A | 5/1977 | Weast | |
| 4,299,044 | A | 11/1981 | Johannsen | |
| D293,206 | S | 12/1987 | Beaty et al. | |
| 4,733,389 | A | 3/1988 | Puvogel | |
| 4,905,395 | A | 3/1990 | Wagner | |
| 4,941,277 | A | 7/1990 | Lawlor | |
| 5,068,992 | A | 12/1991 | Velezis et al. | |
| D331,442 | S | 12/1992 | Bechtel | |
| 5,198,600 | A | 3/1993 | E'Nama | |
| 5,343,650 | A * | 9/1994 | Swan | 42/117 |
| 5,590,484 | A | 1/1997 | Mooney et al. | |
| 5,613,316 | A | 3/1997 | Hightower | |
| 5,727,346 | A | 3/1998 | Lazzarini et al. | |
| 5,826,363 | A | 10/1998 | Olson | |
| 5,941,489 | A | 8/1999 | Fanelli et al. | |
| 6,023,875 | A | 2/2000 | Fell et al. | |
| 6,381,895 | B1 | 5/2002 | Keeney et al. | |
| 6,499,245 | B1 * | 12/2002 | Swan | 42/71.01 |
| 6,508,027 | B1 | 1/2003 | Kim | |
| 6,598,330 | B2 | 7/2003 | Garrett et al. | |
| 6,606,813 | B1 | 8/2003 | Squire et al. | |
| 6,609,321 | B2 | 8/2003 | Faifer | |
| 6,622,415 | B1 | 9/2003 | Canaday et al. | |
| 6,629,381 | B1 | 10/2003 | Keng | |
| 6,637,144 | B2 | 10/2003 | Nebarez et al. | |
| 6,655,069 | B2 | 12/2003 | Kim | |
| 6,671,990 | B1 * | 1/2004 | Booth | 42/75.01 |
| 6,678,988 | B1 | 1/2004 | Poff, Jr. | |
| 6,694,660 | B1 | 2/2004 | Davies | |
| 7,059,076 | B2 * | 6/2006 | Stoner et al. | 42/75.01 |
| 7,131,228 | B2 * | 11/2006 | Hochstrate et al. | 42/75.01 |
| RE39,465 | E | 1/2007 | Swan | |
| D537,902 | S | 3/2007 | Elkaim | |
| D543,605 | S | 5/2007 | Cheng | |
| D556,289 | S | 11/2007 | Yu | |
| 7,305,789 | B2 | 12/2007 | Frost | |
| RE40,216 | E | 4/2008 | Swan | |
| 7,481,016 | B2 * | 1/2009 | Gonzalez | 42/127 |
| 7,574,823 | B2 * | 8/2009 | Nakayama | 42/75.02 |
| 7,694,450 | B2 * | 4/2010 | Keng | 42/124 |
| 7,707,762 | B1 * | 5/2010 | Swan | 42/85 |
| 7,716,865 | B2 * | 5/2010 | Daniel et al. | 42/75.02 |
| 7,770,317 | B1 * | 8/2010 | Tankersley | 42/71.01 |
| 7,793,452 | B1 * | 9/2010 | Samson et al. | 42/72 |
| 7,802,392 | B2 * | 9/2010 | Peterson et al. | 42/75.03 |
| 7,905,041 | B1 * | 3/2011 | Davies | 42/75.02 |
| 7,938,055 | B2 * | 5/2011 | Hochstrate et al. | 89/193 |
| 7,941,959 | B1 * | 5/2011 | Swan | 42/85 |
| 8,051,595 | B2 * | 11/2011 | Hochstrate et al. | 42/75.01 |
| 8,069,604 | B2 * | 12/2011 | Larue | 42/75.1 |
| 2003/0000123 | A1 | 1/2003 | Phillips et al. | |
| 2003/0106251 | A1 | 6/2003 | Kim | |
| 2004/0016169 | A1 | 1/2004 | Poff, Jr. | |
| 2004/0103577 | A1 | 6/2004 | Compton | |
| 2005/0217161 | A1 | 10/2005 | Haugen et al. | |
| 2006/0048432 | A1 | 3/2006 | Staley, III | |
| 2006/0075674 | A1 | 4/2006 | Ding | |
| 2007/0006509 | A1 | 1/2007 | DeSomma et al. | |
| 2007/0017139 | A1 | 1/2007 | Larue | |
| 2007/0163163 | A1 | 7/2007 | Munst | |
| 2007/0169393 | A1 | 7/2007 | Frost | |
| 2007/0199225 | A1 | 8/2007 | Haugen | |
| 2007/0199435 | A1 * | 8/2007 | Hochstrate et al. | 89/191.02 |
| 2008/0168695 | A1 * | 7/2008 | Nakayama | 42/75.02 |
| 2009/0288324 | A1 * | 11/2009 | Peterson et al. | 42/75.03 |
| 2010/0037505 | A1 * | 2/2010 | Romer | 42/124 |
| 2010/0095575 | A1 * | 4/2010 | Swan | 42/72 |
| 2010/0126054 | A1 * | 5/2010 | Daniel et al. | 42/71.01 |
| 2010/0186278 | A1 * | 7/2010 | Daniel | 42/71.01 |
| 2010/0192444 | A1 * | 8/2010 | Cabahug et al. | 42/71.02 |
| 2010/0269392 | A1 * | 10/2010 | Swan | 42/71.01 |
| 2010/0300277 | A1 * | 12/2010 | Hochstrate et al. | 89/179 |
| 2011/0000119 | A1 * | 1/2011 | Desomma et al. | 42/75.02 |
| 2011/0016762 | A1 * | 1/2011 | Davies | 42/75.01 |
| 2011/0061281 | A1 * | 3/2011 | Kapusta et al. | 42/71.01 |
| 2011/0214327 | A1 * | 9/2011 | Desomma | 42/75.02 |
| 2011/0247254 | A1 * | 10/2011 | Barnes | 42/71.01 |

OTHER PUBLICATIONS

"Streamlight Tactical Firearm Light Mounts and Accessories," www.copquest.com.

"Tactical Laser/Light Systems Accessories," www.lagger-pro.com.

"Mounting Solutions Plus," www.mountplus.com.

"Accessories, Tactical Lights, and Flashlights," www.members.aol.com.

"Lights/Flashlights," www.firequest.com.

"Home: Shotgun Parts: Mounts," www.floridagunworks.com.

International Search Report and Written Opinion for related application No. PCT/US2005/010861, mailed Jun. 20, 2005.

International Search Report and Written Opinion mailed Sep. 6, 2010 for related PCT application No. PCT/2010/039532.

Extended European Search Report dated Aug. 5, 2013 for Application No. EP13161102.2.

International Preliminary Report on Patentability mailed Jan. 4, 2012 in International patent application No. PCT/US2010/039532.

* cited by examiner

HAND GUARD ATTACHMENT SYSTEM FOR FIREARMS

CROSS-REFERENCE TO RELATED APPLICATION

This application claims the benefit of provisional patent application Ser. No. 61/219,007, filed Jun. 22, 2009, and entitled "Firearm Operating System." The specification and drawings of the provisional patent application are specifically incorporated herein by reference.

FIELD OF THE INVENTION

The present invention generally relates to firearms and features thereof, and more specifically, to hand guard attachment assemblies for firearms.

BACKGROUND OF THE INVENTION

Semi-automatic and/or fully automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

Conventional firearms may have an integral upper receiver and hand guard. The removable hand guard section can be fastened to the upper receiver with screws or other similar fasteners. Conventional firearms having an upper receiver with integral hand guard may impede field removal and replacement of the barrel. In an M4 type firearm having an upper receiver with integral hand guard, the barrel nut may be covered by the hand guard limiting accessibility to the barrel nut.

SUMMARY OF THE INVENTION

In exemplary embodiments of the invention, a hand guard attachment system having a monolithic rail/hand guard is removably connected to a receiver of a firearm and interfaces with an integral multi-slot mounting portion of the receiver.

In one embodiment, a hand guard attachment assembly is provided for a firearm having a barrel and a receiver fastened to the barrel by a barrel nut. The hand guard attachment assembly includes a forearm including a monolithic mounting rail/hand guard removably connected to the receiver wherein the monolithic rail/hand guard interfaces with an integral multi-slot mounting portion of the receiver. A cinch block is mated to the slots of the receiver and is held in place by the monolithic rail/hand guard. A tension block is mounted at an end of the monolithic rail/hand guard and is attached to the cinch block by a fastener.

In another aspect, a firearm includes a receiver having an integral multi-slot mounting portion on a top surface; a barrel removably connected to the receiver; a forearm including a monolithic rail/hand guard removably connected to the receiver wherein the monolithic rail/hand guard interfaces with the integral mounting portion of the receiver; a cinch block mated to the slots of the receiver and held in place by the monolithic rail/hand guard; and a tension block mated at an end of the monolithic rail/hand guard and attached to the cinch block by a fastener.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

DETAILED DESCRIPTION

The following description is provided as an enabling teaching of embodiments of the invention including the best, currently known embodiment. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

Embodiments of the invention generally are directed to hand guard attachment systems for firearms that include a monolithic rail/hand guard. The embodiments and features thereof can be used with semi-automatic and/or fully automatic firearms including rifles, shotguns, and other long guns, as well as handguns. The firearms can be gas-actuated, inertia-actuated, semi-automatic, pump action, bolt action, etc. The monolithic rail/hand guard mounting assembly allows mounting of a series of different types and configurations of accessories. In one embodiment, the monolithic rail/hand guard mounting assembly can be utilized in M4/AR type rifles.

As illustrated in the figures, a hand guard attachment system in an exemplary embodiment includes a cinch block and a tension block attached to the cinch block to secure a hand guard to an upper receiver of a firearm. Existing lower receivers (not shown) for some military rifles do not require modification to work with the hand guard attachment system. The monolithic rail/hand guard mounting assembly as shown in the figures will fit onto an existing A3 type (for example) upper receiver without substantial modification. The monolithic rail/hand guard mounting assembly and upper receiver section may be configured as shown or otherwise to support such rails as a "Picatinny Rail" configuration as described in Military Standard 1913 (MIL-STD-1913). The monolithic rail/hand guard mounting assembly provides a platform for firearm accessories to be mounted on the rail.

Figure 1:
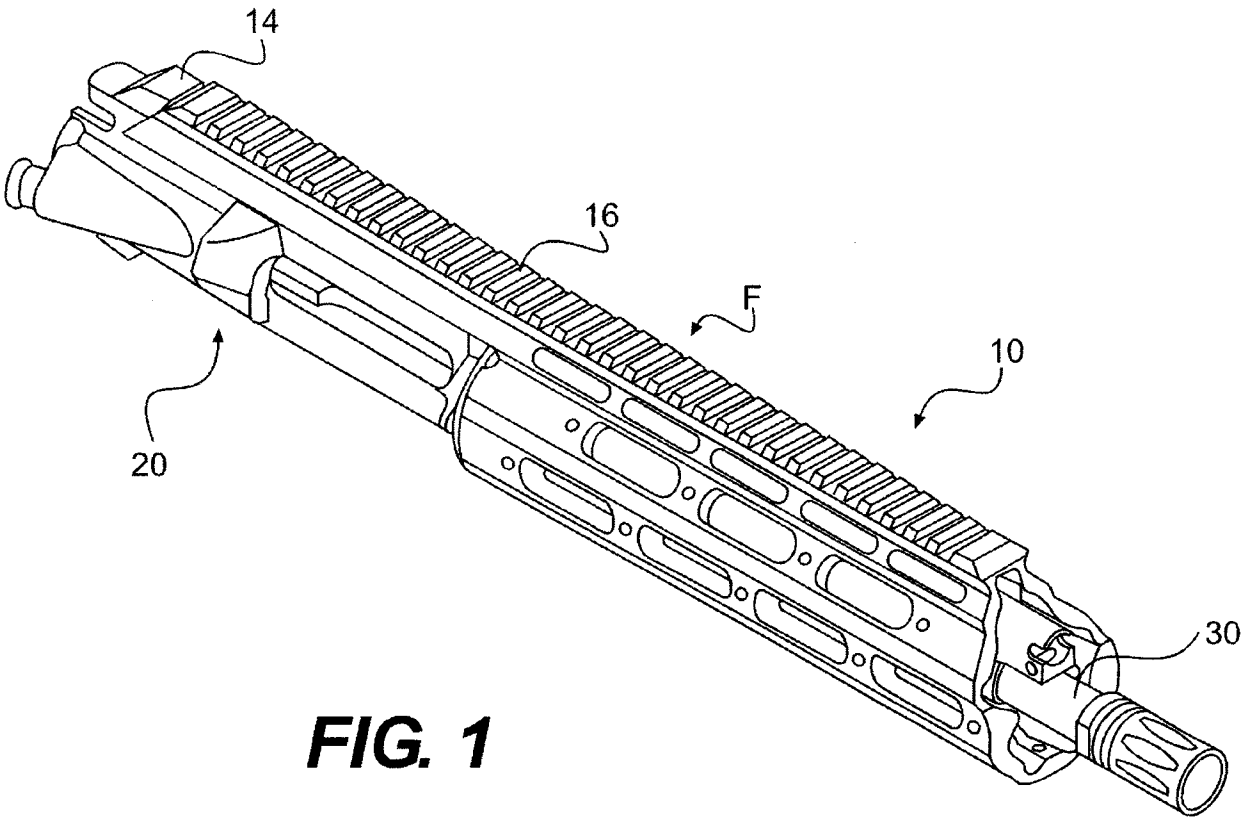
FIG. 1 illustrates an isometric view of the hand guard attachment system for a firearm depicting the upper receiver, barrel, forearm, and forearm tension block in accordance with an exemplary embodiment.

FIG. 1 illustrates an isometric view of the hand guard attachment system for a firearm depicting the upper receiver 20, barrel 30, a forearm 10, and forearm tension block 14 in an exemplary embodiment. The forearm 10 includes a monolithic rail/hand guard 16. The forearm can be extruded, machined, etc.

Figure 2:
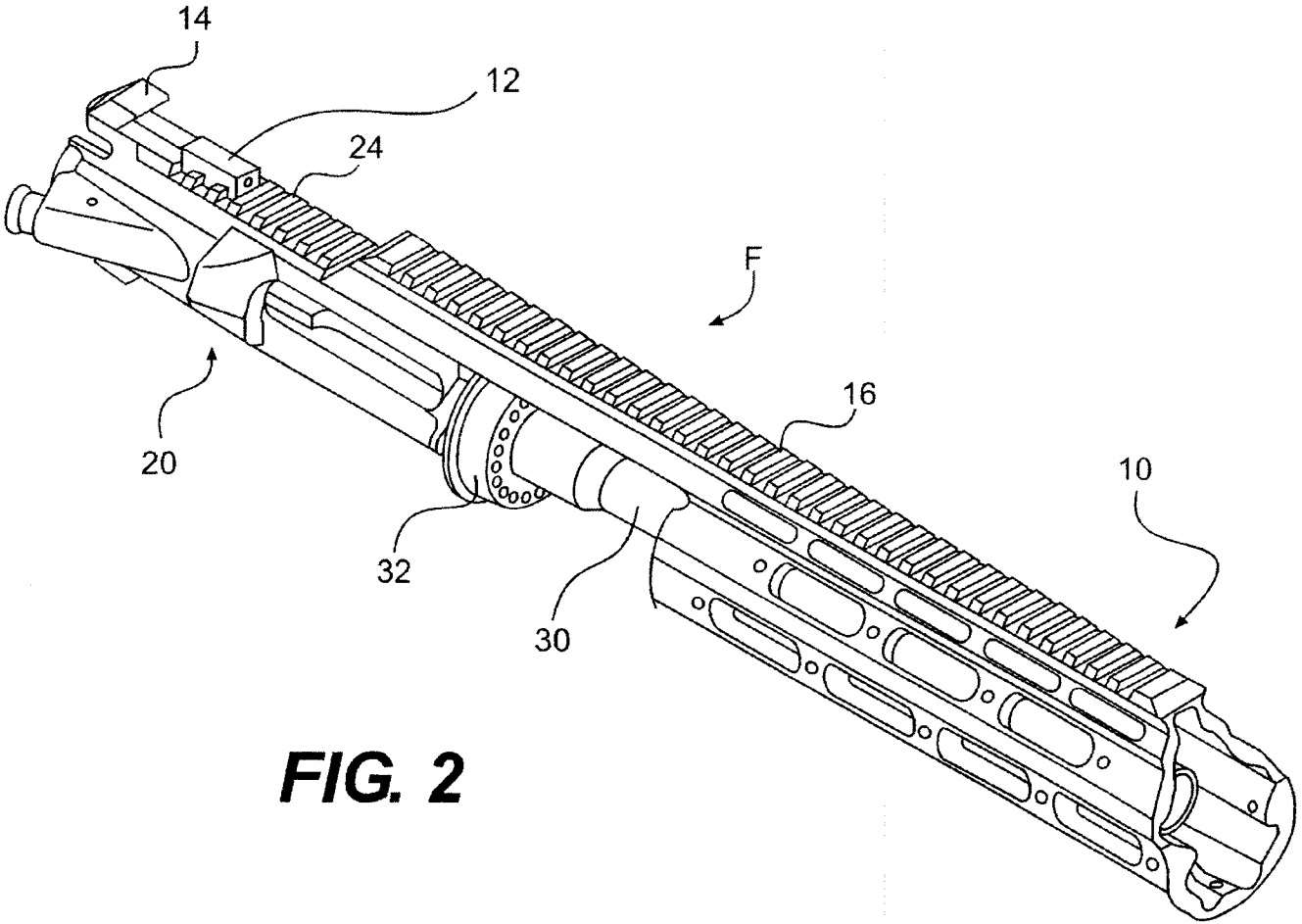
FIG. 2 illustrates an isometric view of the hand guard attachment system for a firearm with the hand guard partially removed depicting the upper receiver, barrel, forearm, forearm tension block, and cinch block in accordance with an exemplary embodiment.

FIG. 2 illustrates an isometric view of the hand guard attachment system for a firearm with the monolithic rail/hand guard partially removed depicting the upper receiver 20, barrel 30, forearm 10, forearm tension block 14, and cinch block 12 in an exemplary embodiment. The forearm 10 includes a monolithic rail/hand guard 16. Barrel nut 32 fastens upper receiver 20 to barrel 30. As shown in FIG. 1, the monolithic rail/hand guard 16 holds the cinch block 12 in place when the forearm 10 is mounted on the firearm F. With the forearm 10 in place, a tension block 14 is positioned at the end of the mounting rail 16 and is shaped to mate with the end of the monolithic rail/hand guard 16. The tension block 14 is attached to the cinch block 12 to secure the monolithic rail/hand guard 16 to the multi-slot mounting portion 24 of upper receiver 20.

Figure 3:
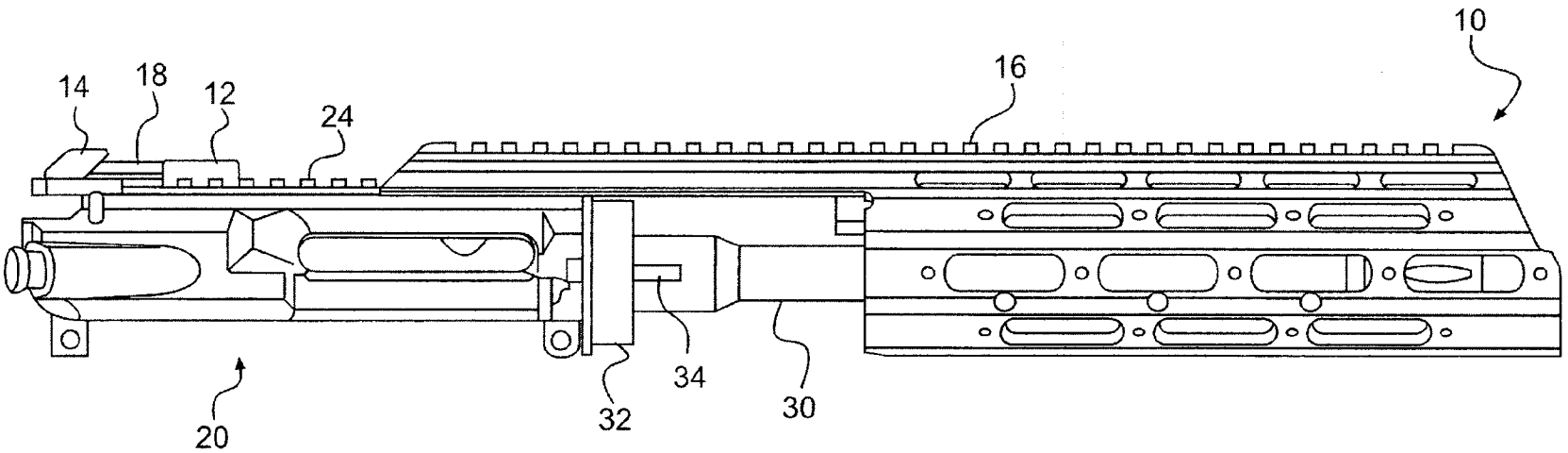
FIG. 3 illustrates a front view of the exemplary hand guard attachment system.
Figure 4:
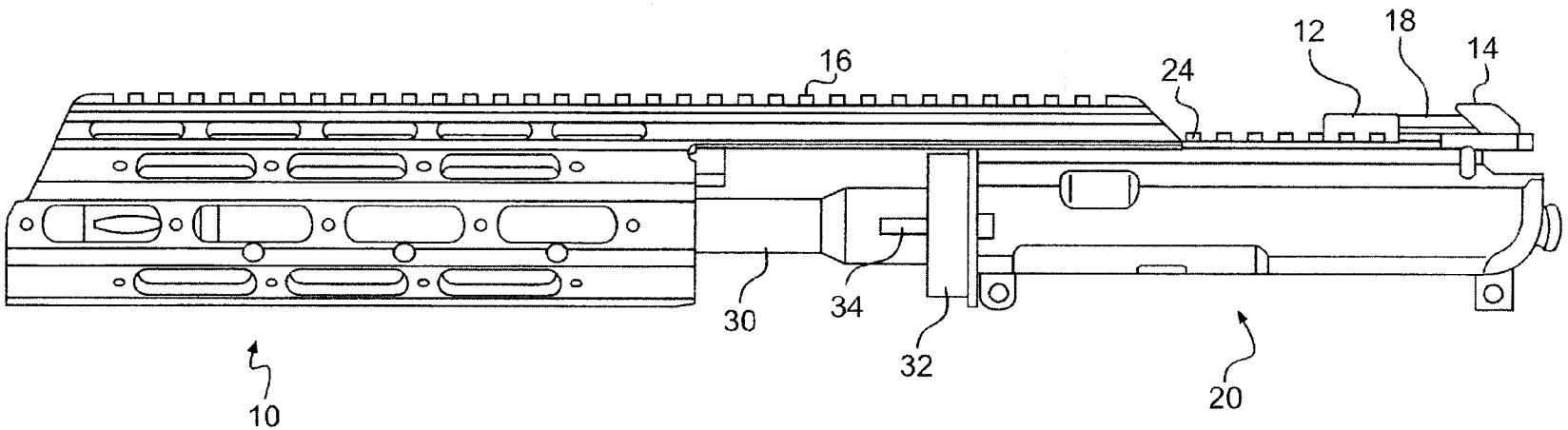
FIG. 4 illustrates a rear view of the exemplary hand guard attachment system.

FIGS. 3-4 illustrates front and rear views, respectively, of the exemplary hand guard attachment assembly. The cinch block 12 has multiple projections and slots that are shaped to fit the slots and rails, respectively, on the upper surface of receiver 20. The tension block 14 is attached to cinch block 12 using a socket head cap screw 18. Barrel nut 32 attaches the upper receiver 20 to the barrel 30. Two mounting bolts 34 passing through axial holes in the barrel nut 32 are used as the primary securing mechanism for affixing the monolithic rail/hand guard 16 to the firearm. Alternately, a single mounting bolt 34 can be used to secure the monolithic rail/hand guard 16 to the firearm. The barrel nut 32 can provide an undercut seating location for the fore-end, can provide at least one guide hole, and preferably two holes for location of cap screw fasteners to secure the fore-end, and can provide "top dead center hole" aligns, in addition to providing support for the operating rod.

Figure 5:
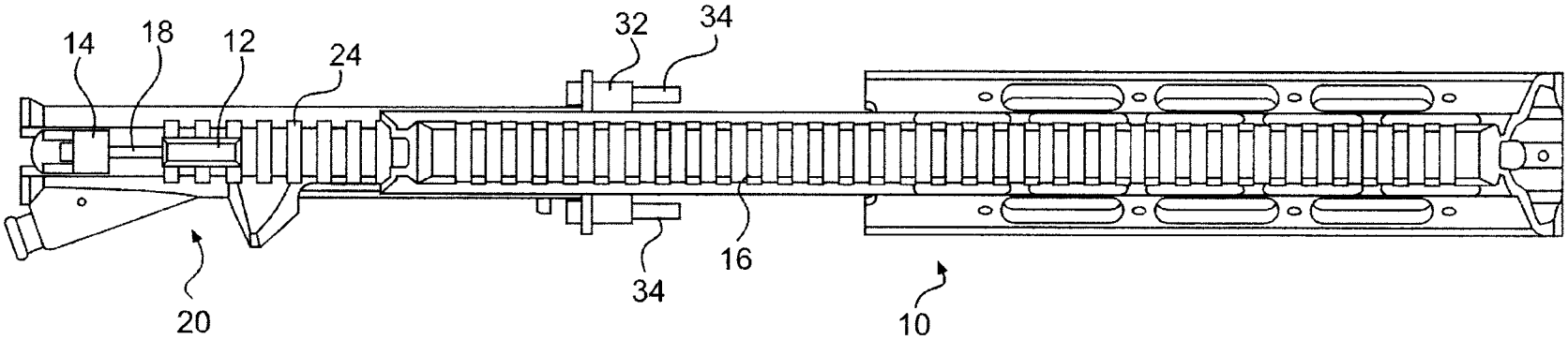
FIG. 5 illustrates a top view of the exemplary hand guard attachment system.

FIG. 5 illustrates a top view of the exemplary hand guard attachment assembly. With the monolithic rail/hand guard 16 partially removed, the figure shows the cinch block 12 mated to several slots of the multi-slot mounting portion 24 on the top of the receiver 20. The figure also shows the tension block 14 attached to the cinch block 12 by cap screw 18. Barrel nut 32 and barrel nut bolts 34 are also depicted.

Figure 6:
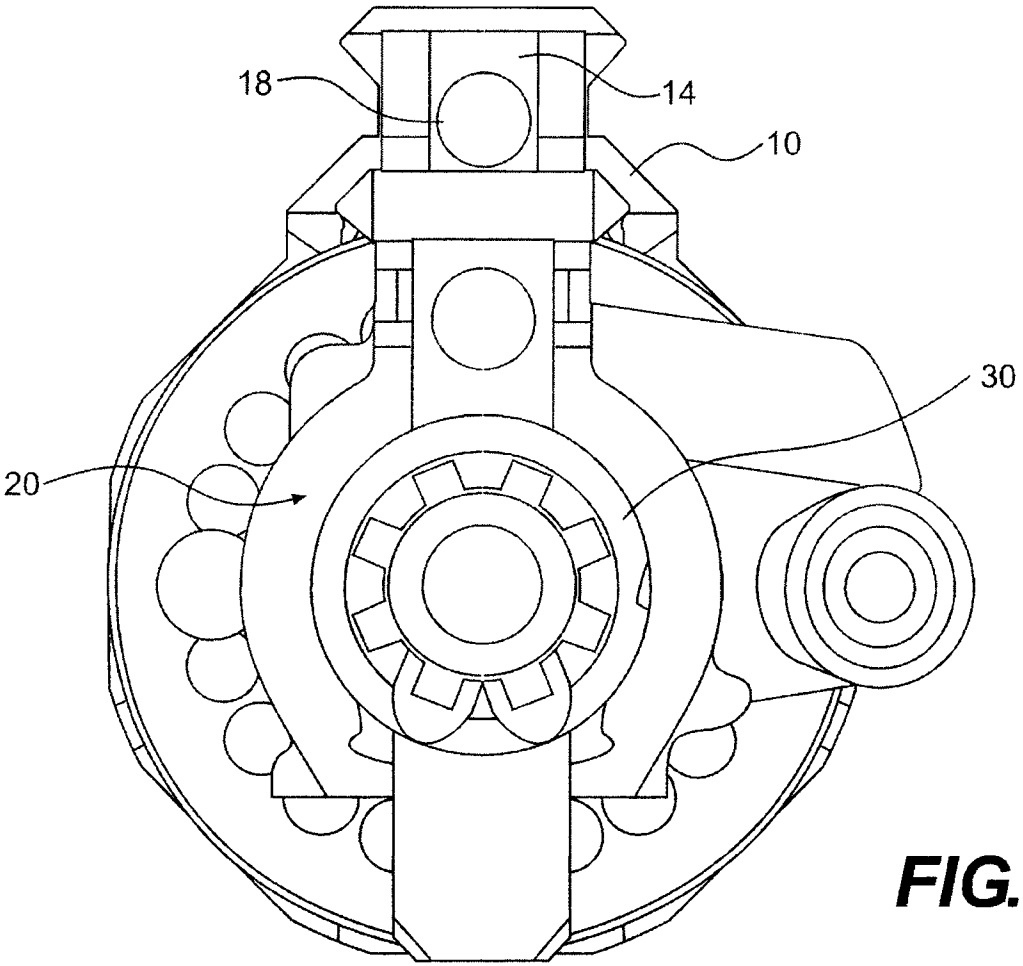
FIGS. 6-7 illustrate end views of the exemplary hand guard attachment system.
Figure 7:
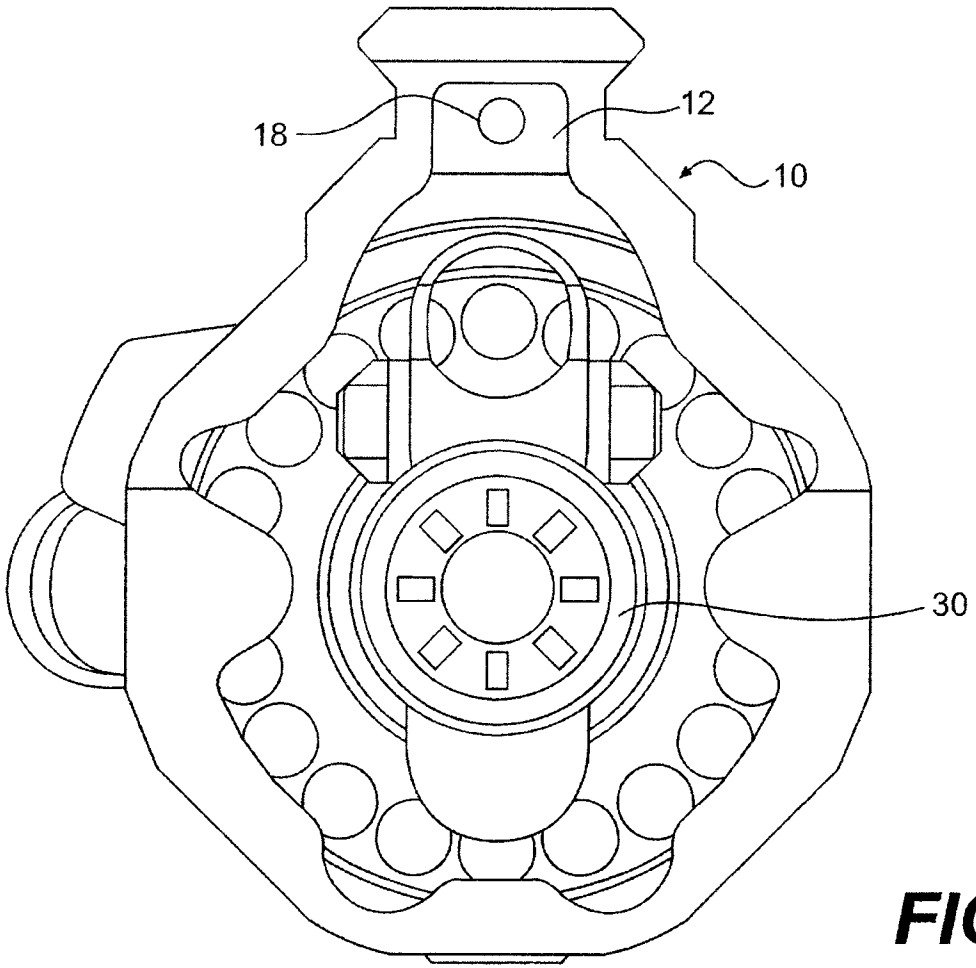

FIGS. 6-7 show end views of the exemplary receiver 20, barrel 30, forearm 10, and hand guard attachment assembly. FIG. 6 shows a left side end view that depicts tension block 14 and cap screw 18. FIG. 7 shows a right side end view that depicts the cinch block 12 and cap screw 18.

Figure 8:
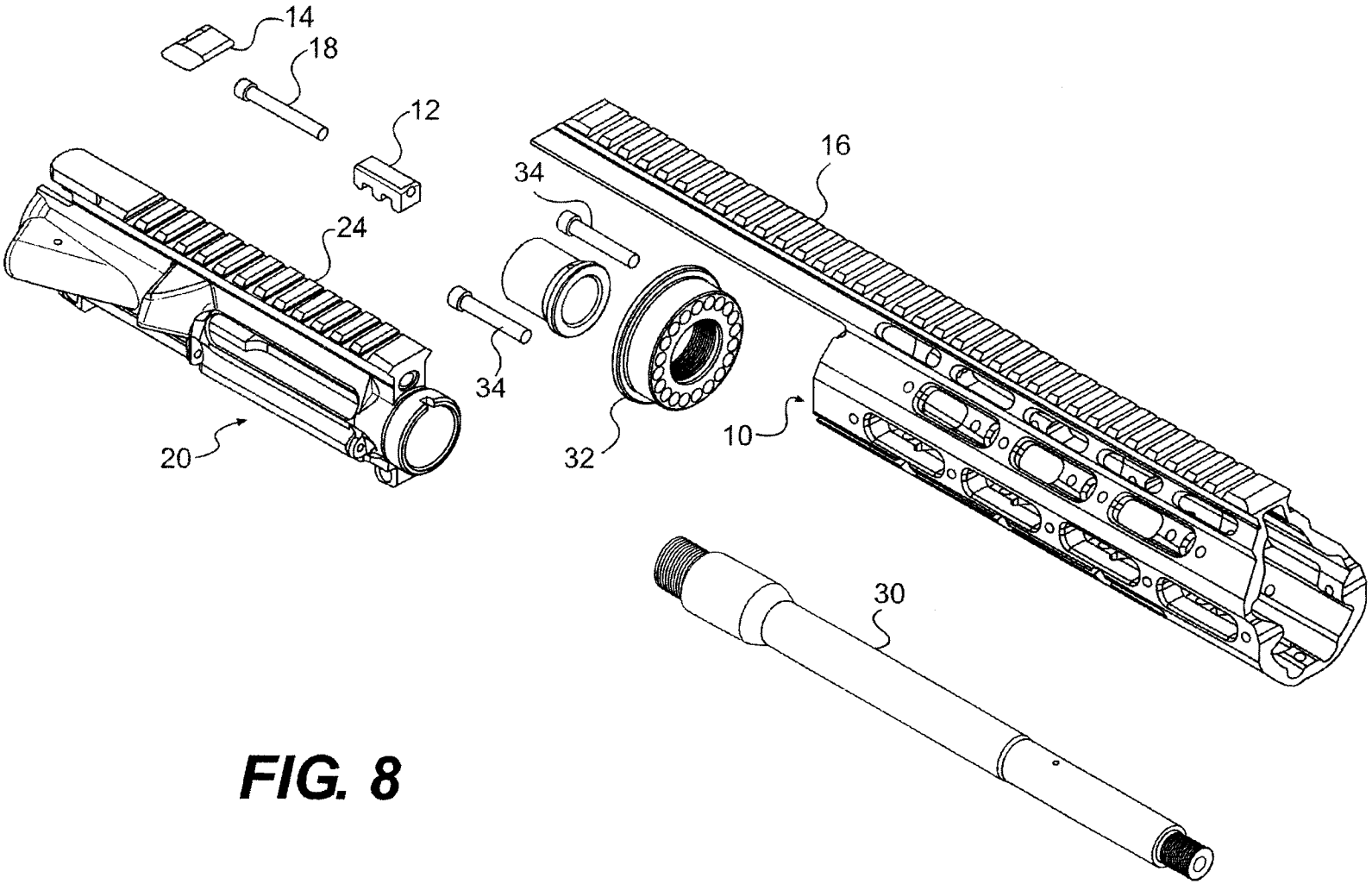
FIGS. 8-10 illustrate exploded views of the exemplary hand guard attachment system.
Figure 9:
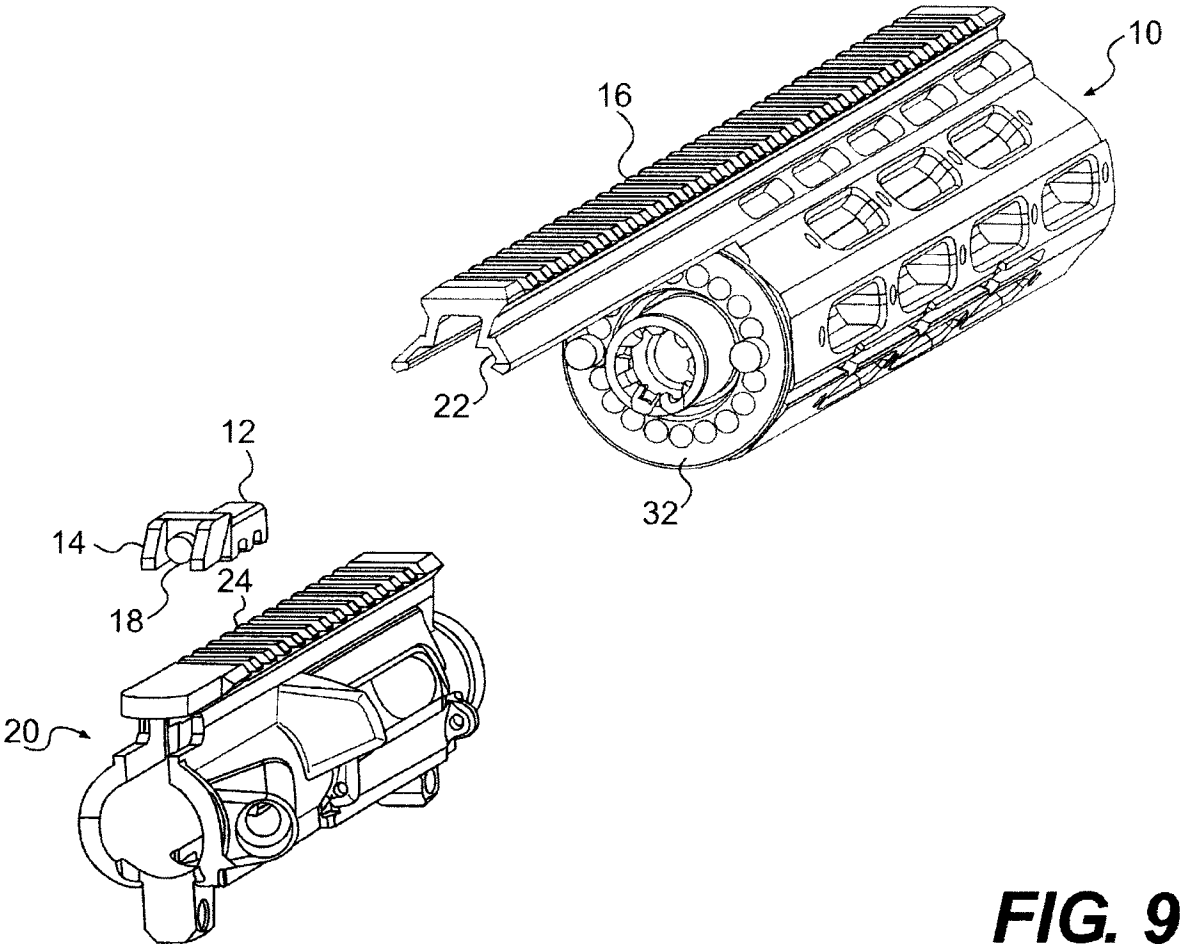
Figure 10:
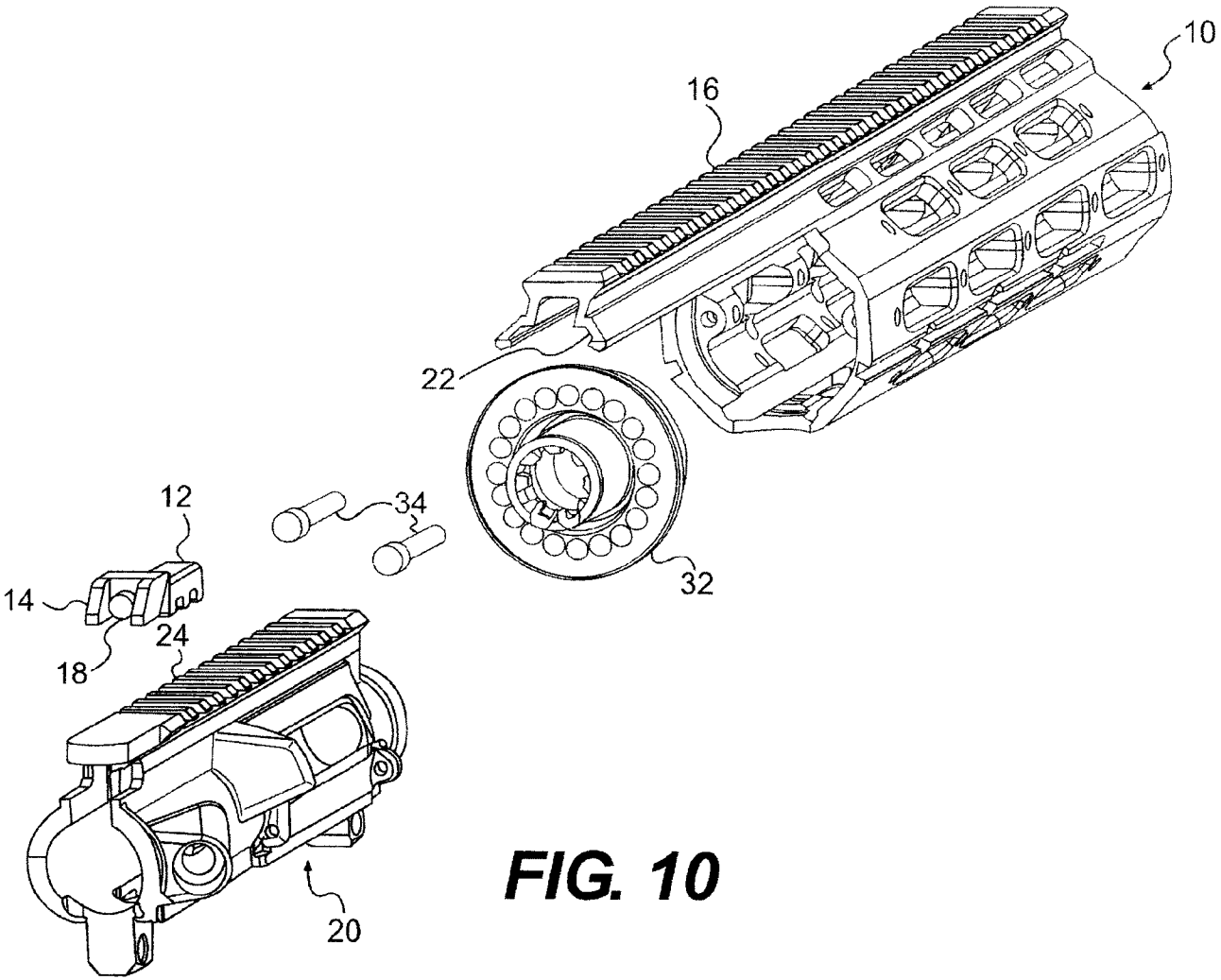

FIG. 8-10 illustrate exploded views of the exemplary hand guard attachment system. FIG. 8 shows forearm 10, upper receiver 20, barrel 30, barrel nut 32, barrel nut fasteners 34, monolithic rail/hand guard 16, cinch block 12, tension block 14, and fastener 18. FIG. 9 shows another exploded view showing receiver 20 with a multi-slot mounting portion on the top section of the receiver. The forearm 10 includes monolithic rail/hand guard 16 and female Picatinny mount 22. Cinch block 12 and tension block 14 are attached by fastener 18 which can be a socket head cap screw. FIG. 10 shows a further exploded view showing receiver 20 with multi-slot mounting portion 24, forearm 10 with monolithic rail/hand guard 16 and female Picatinny mount 22. As shown in FIGS. 9-10, female Picatinny mount 22, integral to the monolithic rail/hand guard 16, can interface with a Picatinny rail surface 24 on the top of the upper receiver 20, and utilizes a cinch block 12 and tensioning device 14 to aid in holding the monolithic rail/hand guard 16 in position. Barrel nut 32 and barrel nut fasteners 34 are shown in this exploded view.

The cinch block 12 mates with the grooves (slots) in the Picatinny rails 24 on the upper receiver 20. The forearm 10 having monolithic rail/hand guard 16 is positioned over the upper receiver 20 with the cinch block 12 in place. The forearm 10 prevents the cinch block 12 from lifting out of the grooves. The tension block 14 is positioned adjacent the end of the hand guard 16 and is secured to the cinch block 12 by a fastener 18, such as a socket head cap screw. The tension block 14 is fabricated from aluminum or steel and is shaped to mate with the angled end of the monolithic rail/hand guard 16. The cinch block 12 is fabricated from steel in one embodiment. This mechanical overlap also can help reduce movement of monolithic rail/hand guard 16 due to vertical bending forces applied between the receiver 20 and barrel 30. Additionally the monolithic rail/hand guard 16 allows optics or other accessories to be mounted further forward without the optics acting as a bridge between two pieces. For a gas-operated firearm, the upper receiver 20 can be modified further to accept a larger diameter rod in place of the standard gas impingement tube. Thus, the described embodiments further enable modularity and compatibility of the monolithic rail/hand guard 16 with existing receivers and existing equipment (optics, hand rails, etc.), the system being easily configurable to accommodate most currently available off-the-shelf systems based on user preference.

An additional feature of this system lies in the ability to remove some components from the front of the gun without necessarily removing the hand guard and rail assembly. Thus cleaning, maintenance and malfunction clearing are improved.

The exemplary multi-slot mounting portions 16, 24 described above and in the figures may correspond to the MIL-STD-1913 Picatinny rail mounting system. Other rail/slot mounting arrangements can be incorporated in the mounting portions 16, 24.

The components of the hand guard attachment system can be made from conventional durable, high strength materials including metals such as aluminum, carbon fibers, composites, and other materials. The type of firearm is not a limitation of the exemplary hand guard attachment system as described herein.

The corresponding structures, materials, acts, and equivalents of all means plus function elements in any claims below are intended to include any structure, material, or acts for performing the function in combination with other claim elements as specifically claimed. Those skilled in the art will appreciate that many modifications to the exemplary embodiments are possible without departing from the scope of the present invention.

In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the present invention is defined solely by the appended claims.

What is claimed:

1. A firearm comprising:

a receiver having an integral multi-slot rail portion including at least one transverse slot formed along a top surface of the receiver;

a barrel removably connected to the receiver;

a forearm including a monolithic mounting rail/hand guard removably connected to the receiver wherein the monolithic rail/hand guard interfaces with the integral rail portion of the receiver;

a cinch block having at least one projection adapted to engage and mate with the at least one transverse slot of the receiver, the cinch block configured to engage and be held in place by the monolithic rail/hand guard;

a tension block mated with a rear end of the monolithic rail/hand guard and attached to the cinch block by a fastener wherein the mating engagement of the tension block with the monolithic rail/hand guard and the cinch block with the at least one transverse slot of the receiver removably secures the monolithic rail/hand guard to the receiver.

2. The firearm of claim 1 further comprising a barrel nut to fasten the barrel to the receiver.

3. The firearm of claim 2 further comprising at least one mounting bolt that passes through a hole in the barrel nut into a threaded hole in the forearm to affix the monolithic rail/hand guard to the firearm.

4. The firearm of claim 1 wherein the integral multi-slot rail portion of the top of the receiver comprises a Picatinny rail.

5. The firearm of claim 4 wherein the monolithic rail/hand guard comprises an integral female Picatinny mount that interfaces with the Picatinny rail surface on the top of the receiver.

6. The firearm of claim 1 wherein the at least one transverse slot of the receiver comprises a plurality of transverse slots, and the at least one projection of the cinch block comprises a plurality of projections that interface with the plurality of slots of the integral multi-slot rail portion of the receiver.

7. The firearm of claim 1 wherein the cinch block and tension block hold the monolithic rail/hand guard in a fixed position during operation of the firearm.

8. A hand guard attachment assembly for a firearm having a barrel and a receiver fastened to the barrel by a barrel nut, the hand guard attachment assembly comprising:

a forearm including a monolithic mounting rail/hand guard removably connected to the receiver wherein the monolithic rail/hand guard interfaces with an integral multi-slot mounting portion of the receiver, the internal multi-slot mounting portion of the receiver comprising at least one transverse slot formed along an upper surface of the receiver;

a cinch block mated to the at least one transverse slot of the receiver and configured to engage the monolithic rail/hand guard so as to be held in place along the receiver by the monolithic rail/hand guard;

a tension block mated to a rear end of the monolithic rail/hand guard and attached to the cinch block by a fastener for connecting the monolithic rail/hand guard to the receiver.

9. The hand guard attachment assembly of claim 8 and further comprising at least one mounting bolt that passes through a hole in the barrel nut into a threaded hole in the forearm to affix the monolithic rail/hand guard to the barrel nut of the firearm.

10. The hand guard attachment assembly of claim 8 wherein the monolithic rail/hand guard comprises an integral female Picatinny mount that interfaces with a Picatinny rail surface on the top of the receiver.

11. The hand guard attachment assembly of claim 8 wherein the at least one transverse slot of the receiver comprises a plurality of slots formed along the upper surface of the receiver, and the cinch block comprises a plurality of projections that interfaces with the plurality of slots of the receiver.

12. The hand guard attachment assembly of claim 9 wherein the cinch block and tension block hold the monolithic rail/hand guard in a fixed position during operation of the firearm.

13. A method for mounting a hand guard attachment assembly to a firearm, comprising:

providing a firearm having a receiver with an integral multi-slot mounting portion comprising at least one transverse slot along an upper surface of the receiver, and a barrel;

mating a cinch block with the at least one transverse slot of the receiver;

mounting a forearm including a monolithic mounting rail/hand guard to the receiver, wherein the monolithic rail/hand guard interfaces with the integral multi-slot mounting portion of the receiver and the cinch block, with the cinch block engaged therebetween; and mating a tension block to a rear end of the monolithic rail/hand guard extending along the integral multi-slot mounting portion of the receiver, and attaching the tension block to the cinch block by a fastener;

wherein the mating engagement of the tension block with the monolithic rail/hand guard and the cinch block with the at least one transverse slot of the receiver removably secures the monolithic rail/hand guard to the receiver.

14. The method of claim 13 further comprising fastening the barrel to the receiver using a barrel nut.

15. The method of claim 14 further comprising attaching the monolithic rail/hand guard to the firearm with at least one mounting bolt that passes through a hole in the barrel nut into a threaded hole in the forearm.

* * * * *